US008297245B2

(12) United States Patent
Urushihata

(10) Patent No.: US 8,297,245 B2
(45) Date of Patent: Oct. 30, 2012

(54) VALVE TIMING ADJUSTER

(75) Inventor: Haruyuki Urushihata, Chiryu (JP)

(73) Assignee: Denso Corporation, Kariya (JP)

( * ) Notice: Subject to any disclaimer, the term of this patent is extended or adjusted under 35 U.S.C. 154(b) by 320 days.

(21) Appl. No.: 12/852,283

(22) Filed: Aug. 6, 2010

(65) Prior Publication Data

US 2011/0030633 A1 Feb. 10, 2011

(30) Foreign Application Priority Data

Aug. 7, 2009 (JP) ..... 2009-185022

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,505,586 B1 1/2003 Sato et al.
6,837,200 B2 * 1/2005 Ichinosawa ..... 123/90.17
2002/0139332 A1 10/2002 Takenaka

FOREIGN PATENT DOCUMENTS

JP 11-210424 8/1999

OTHER PUBLICATIONS

U.S. Appl. No. 12/852,273, Urushihata, filed Aug. 6, 2010.
U.S. Appl. No. 12/828,793, filed Jul. 1, 2010, Urushihata et al.

* cited by examiner

*Primary Examiner* — Zelalem Eshete
(74) *Attorney, Agent, or Firm* — Nixon & Vanderhye PC

(57) ABSTRACT

A valve timing adjuster includes a first rotor, a second rotor, a control valve, and a lock mechanism. The lock mechanism includes a retard limitation pin and an advance limitation pin, each of which is provided to the second rotor. The lock mechanism includes a retard limitation groove and an advance limitation groove, each of which is formed to the first rotor. The retard limitation groove and the advance limitation groove are designed to limit the displacement of the retard limitation pin in the retard direction and simultaneously limit the displacement of the advance limitation pin in the advance direction in order to lock the first rotor and the second rotor. The valve timing adjuster alternately increases the oil pressure in the retard chamber and the oil pressure in the advance chamber when the lock of the first and second rotors is released.

13 Claims, 8 Drawing Sheets

VALVE TIMING ADJUSTER

CROSS REFERENCE TO RELATED APPLICATION

This application is based on and incorporates herein by reference Japanese Patent Application No. 2009-185022 filed on Aug. 7, 2009.

BACKGROUND OF THE INVENTION

1. Field of the Invention

The present invention relates to a valve timing adjuster that adjusts timing of opening and closing an intake valve or an exhaust valve of an engine.

2. Description of Related Art

A conventional valve timing adjuster includes a housing (first rotor), and a vane rotor (second rotor). The housing is rotatable synchronously with one of an engine output shaft and a camshaft that opens and closes an intake valve or an exhaust valve. The vane rotor is rotatable synchronously with the other one of the output shaft and the camshaft. Also, the housing has therein advance hydraulic chambers and retard hydraulic chambers defined by vanes of the vane rotor. Then, a phase control is performed to adjust a relative rotational position (relative rotational phase) of the vane rotor relative to the housing by adjusting pressure of hydraulic oil supplied to the advance and the retard hydraulic chambers in order to adjust timing of opening and closing the valve.

However, if a drive source of a hydraulic pump, which supplies hydraulic oil, serves as the engine output shaft, the hydraulic oil may not be substantially supplied immediately after the starting of the engine. Then, the relative rotational phase may be substantially varied due to the position change of the vane rotor that is subjected to variable torque (torque reversals) applied through the camshaft caused by a valve spring of the intake valve or the exhaust valve.

Thus, in the conventional apparatus described in JP-A-2002-357105 (corresponding to US20020139332), the vane rotor is provided with a lock pin, and the housing is provided with a lock hole. When a projection condition is satisfied, the lock pin is displaced from a retraction position, at which the lock pin is retracted within the vane rotor, to a projection position, at which the lock pin projects from the vane rotor. When the lock pin located at the projection position is fitted into or engaged with the lock hole, the relative rotational phase of the vane rotor is locked such that the vane rotor is prevented from rotating relative to the housing. As a result, if a lock control is executed, in which the relative rotational phase is controlled such that the lock pin is engaged with the lock hole, during the stopping of the engine, the relative rotational phase has been locked accordingly at the start of the engine in the next operation. As a result, it is possible to prevent the wide change of the relative rotational phase at the engine start.

Then, when it becomes possible to supply substantial amount of hydraulic oil after the engine start, and thereby a projection condition becomes unsatisfied, the lock pin is retracted to be received in the vane rotor such that the lock of the relative rotational phase is released. Subsequently, the feed-back control is executed, in which the phase control is controlled based on a difference between the actual phase and the target phase computed in accordance with the engine operational state.

A conventional valve timing adjuster is usually designed such that the phase is locked to a full retard position. However, in a recent apparatus, the phase is alternatively locked to a position between the full retard position and a full advance position, and the inventor of the present invention has found the following disadvantages in the recent apparatus.

In other words, as shown in FIG. 9A, a clearance CL is formed between a side surface (pin side surface 250*w*) of an advance limitation pin 250 and a wall surface (hole wall surface 211*w*) of a lock hole 211. However, when the advance limitation pin 250 is displaced from the projection position to the retraction position in a lock release operation, the pin side surface 250*w* is pressed against the hole wall surface 211*w* due to an oil pressure difference between the advance chambers and the retard chambers and due to the variable torque (torque reversals), as shown in FIG. 9C and FIG. 9B.

As a result, in a lock mechanism that is configured to lock the phase at a position between the full retard position and the full advance position, because the pin side surface 250*w* is pressed against the hole wall surface 211*w*, a frictional force is generated between the pin side surface 250*w* and the hole wall surface 211*w*, and thereby the frictional force makes it difficult to disengage the advance limitation pin 250 from the lock hole 211. Thus, it may be impossible to quickly release the lock even when the sufficient hydraulic oil has been supplied after the engine start disadvantageously.

In another lock mechanism that is configured to lock the phase at the full retard position, the above disadvantageous state will not occur when the duration of the state shown in FIG. 9A is elongated by the following setting and operation. The advance limitation pin 250 and the lock hole 211 are designed such that the advance limitation pin 250 is located at the position shown in FIG. 9A when the first rotor and the second rotor are located at the full retard position. Also, the system is controlled such that the oil pressure difference between the advance chamber and the retard chamber is applied in the retard direction. The above setting and operation makes it possible to elongate the duration of the physical relation between the advance limitation pin 250 and the lock hole 211.

SUMMARY OF THE INVENTION

The present invention is made in view of the above disadvantages. Thus, it is an objective of the present invention to address at least one of the above disadvantages.

To achieve the objective of the present invention, there is provided a valve timing adjuster for an engine, which adjuster includes a first rotor, a second rotor, a control valve, and a lock mechanism. The first rotor is rotatable synchronously with one of a camshaft of the engine and an output shaft of the engine, and the camshaft opens and closes one of an intake valve and an exhaust valve of the engine. The second rotor is rotatable synchronously with the other one of the camshaft and the output shaft, and the second rotor defines a retard chamber and an advance chamber between the first rotor and the second rotor. The control valve is configured to control supply of hydraulic oil to the retard chamber and the advance chamber. The controlling means controls the control valve to increase oil pressure of hydraulic oil in the retard chamber in order to shift a relative rotational phase between the first rotor and the second rotor in a retard direction. The controlling means controls the control valve to increase oil pressure of hydraulic oil in the advance chamber in order to shift the relative rotational phase in an advance direction. The lock mechanism is configured to lock the first rotor and the second rotor at a lock position located between a full retard position and a full advance position such that the first rotor is limited from being rotated relative to the second rotor. The lock mechanism includes a retard limitation pin and an advance limitation pin, each of which is provided to the second rotor. Each of the retard limitation pin and the advance limitation pin is displaced from a corresponding retraction position, at which each of the limitation pins is retracted within the second rotor, to a corresponding projection position, at which each of the limitation pins projects from the second rotor, when a projection condition is satisfied. Each of the limitation pins is displaced to the corresponding retraction position when a retraction condition is satisfied. The lock mechanism includes a retard limitation groove and an advance limitation groove, each of which is formed to the first rotor. The retard limitation groove limits the retard limitation pin, which is located at the corresponding projection position, from being displaced in the retard direction. The advance limitation groove limits the advance limitation pin, which is located at the corresponding projection position, from being displaced in the advance direction. The retard limitation groove and the advance limitation groove are designed to limit the displacement of the retard limitation pin in the direction and simultaneously limit the displacement of the advance limitation pin in the advance direction in order to lock the first rotor and the second rotor such that the first rotor is limited from being rotated relative to the second rotor. The controlling means includes lock release controlling means for alternately increasing the oil pressure in the retard chamber and the oil pressure in the advance chamber when the lock of the first and second rotors is released by displacing each of the retard limitation pin and the advance limitation pin from the corresponding projection position to the corresponding retraction position.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Each embodiment of the present invention will be described below with reference to accompanying drawings. It should be noted that similar components of one embodiment, which are similar to the components of the other embodiment, will be designated by the same numerals, and the explanation thereof will be omitted. It should be noted that in the present invention, feature configurations of each embodiment may be combined as required.

First Embodiment

Figure 1:
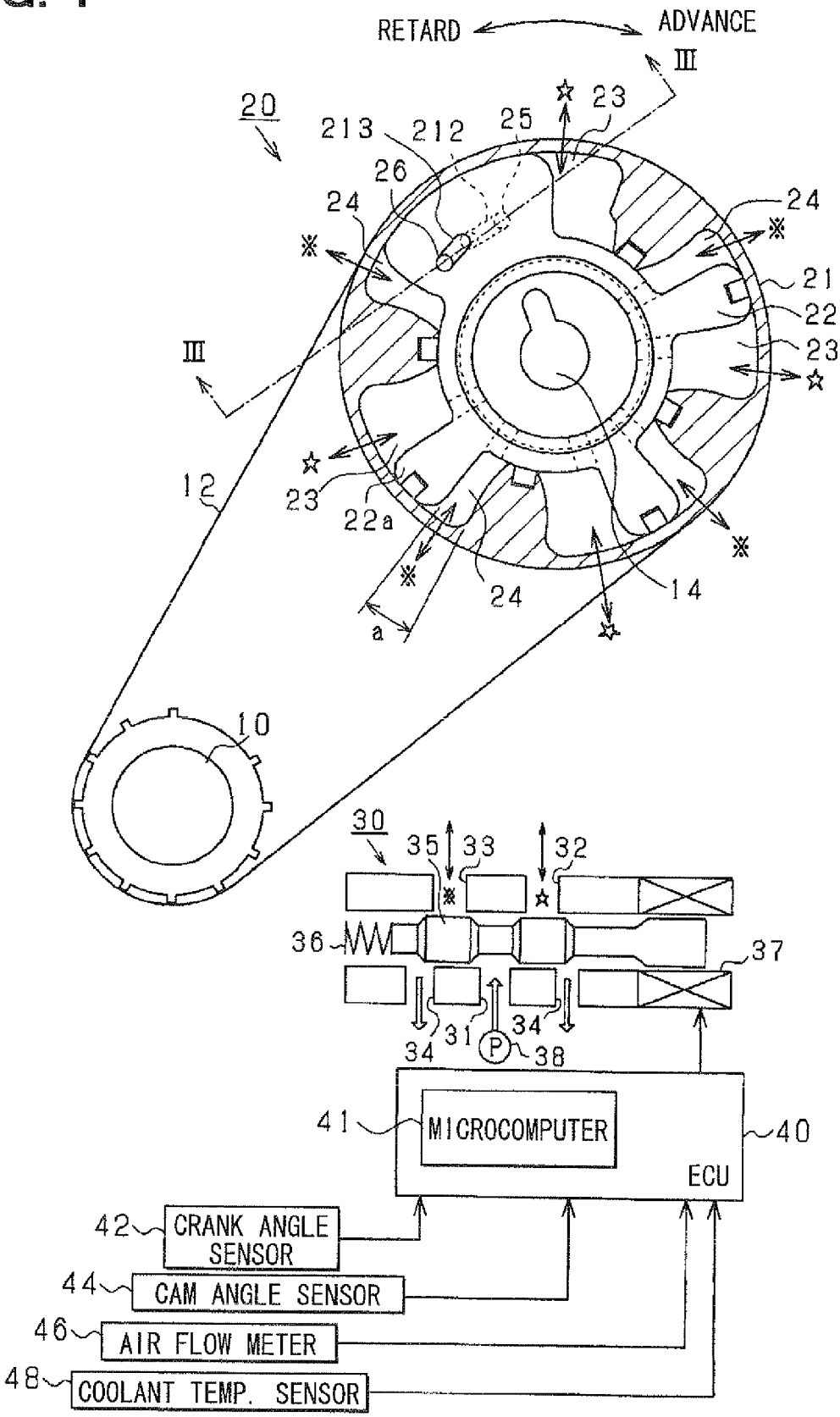
FIG. 1 is a diagram illustrating a general configuration of a valve timing adjuster according to the first embodiment of the present invention.

FIG. 1 is a general configuration illustrating a valve timing adjuster of the present embodiment.

As shown in FIG. 1, a drive force of a crankshaft 10 (output shaft) of an engine is transmitted to a camshaft 14 through a belt 12 and a valve timing adjuster or a variable valve timing device (VVT) 20. The VVT 20 includes a first rotor 21 (housing) and a second rotor 22 (vane rotor). The first rotor 21 is mechanically coupled to the crankshaft 10, and the second rotor 22 is mechanically coupled to the camshaft 14. In the present embodiment, the second rotor 22 has multiple projection portions 22*a* (vane), and is received within the first rotor 21. The projection portions 22*a* of the second rotor 22 and an inner wall of the first rotor 21 define therebetween retard chambers 23 and advance chambers 24. The retard chambers 23 cause a rotation angle (relative rotational phase) of the camshaft 14 relative to the crankshaft 10 to be shifted in a retard direction, and the advance chambers 24 cause the relative rotational phase to be shifted in an advance direction, for example.

Also, the VVT 20 further includes a lock mechanism that locks the first rotor 21 and the second rotor 22 at an intermediate position such that the first rotor 21 is incapable of rotating relative to the second rotor 22. For example, the intermediate position is located between a full retard position and a full advance position. The retard chambers 23 have maximum volume when the relative rotational phase is at the full retard position, and the advance chambers 24 have maximum volume when the relative rotational phase is at the full advance position. The lock mechanism will be described later. It should be noted that the "intermediate position" of the present embodiment is a phase or a position that is located at the middle point of the full retard position and the full advance position. However, the "intermediate position" of the present invention is not limited to the above middle point. For example, the intermediate position may be a position that is displaced from the middle point toward the full retard position or toward the full advance position.

The VVT 20 serves as a hydraulic actuator and has an oil control valve (OCV) 30 that controls circulation of hydraulic oil between the retard chambers 23 and the advance chambers 24.

The OCV 30 supplies hydraulic oil to the retard chambers 23 or the advance chambers 24 from a hydraulic pump 38 through a supply route 31 and a retard route 32 or an advance route 33. The OCV 30 drains hydraulic oil to an oil pan through the retard chambers 23, the retard route 32, and a drain route 34, or through the advance chambers 24, the advance route 33, and another drain route 34. It should be noted that the hydraulic pump 38 is driven by the rotational torque of the crankshaft 10. Thus, when the engine rotation speed is higher, pressure of hydraulic oil discharged by the hydraulic pump 38 becomes higher. In contrast, when the engine rotation speed is lower, the hydraulic oil pressure becomes lower, accordingly.

A spool 35 is urged by a spring 36 rightward in FIG. 1 (in a direction from the advance route 33 toward the retard route 32), and an electromagnetic solenoid 37 provides a force that urges the spool 35 leftward in FIG. 1. Thus, by adjusting a duty (Duty) of a control electric current (control command value) applied to the electromagnetic solenoid 37, it is possible to control a position of the spool 35, and thereby it is possible to cause the spool 35 to adjust flow channel areas between (a) one of the retard route 32 and the advance route 33 and (b) one of the supply route 31 and the drain routes 34.

For example, when the spool 35 is displaced from a position shown in FIG. 1 in a right direction, hydraulic oil is supplied to the retard chambers 23 from the hydraulic pump 38 through the supply route 31 and the retard route 32, and hydraulic oil in the advance chambers 24 is drained to the oil pan through the advance route 33 and the drain route 34. As a result, the second rotor 22 rotates counterclockwise relative to the first rotor 21 in FIG. 1, and thereby the relative rotational phase is shifted in the retard direction.

In contrast, when the spool 35 is displaced from the shown position in a left direction, hydraulic oil is supplied to the advance chambers 24 from the hydraulic pump 38 through the supply route 31 and the advance route 33, and hydraulic oil in the retard chambers 23 is drained to the oil pan through the retard route 32 and the drain route 34. As a result, the second rotor 22 rotates clockwise relative to the first rotor 21, and thereby the relative rotational phase is shifted in the advance direction.

Note that when the spool 35 is located at the position shown in FIG. 1 such that the spool 35 closes the retard route 32 and the advance route 33, circulation of hydraulic oil between the retard chambers 23 and the advance chambers 24 is prohibited, and thereby the relative rotational phase is held. The duty value of the control electric current at the above state, where the relative rotational phase is held, is referred to as a hold Duty value (hold value).

An electronic control unit (ECU) 40 mainly includes a microcomputer 41, and adjusts the duty of the control electric current applied to the electromagnetic solenoid 37. The ECU 40 obtains detection values of various operational state of the internal combustion engine, such as a detection value of a crank angle sensor 42, which detects a rotation angle of the crankshaft 10, a detection value of a cam angle sensor 44, which detects a rotation angle of the camshaft 14, and a detection value of an air flow meter 46, which detects an intake air amount. Also, the detection values obtained by the ECU 40 include detection values of a coolant sensor 48 that detects temperature of engine coolant. The ECU 40 performs various computation based on the above various detection values, and controls various actuators, such as the OCV 30, of the internal combustion engine based on the computation result.

For example, the ECU 40 computes an engine rotational speed NE based on the detection value of the crank angle sensor 42, and computes an intake amount (engine load) based on the detection value of the air flow meter 46. Also, the ECU 40 computes an actual relative rotational phase (actual phase) based on the detection values of the crank angle sensor 42 and the cam angle sensor 44. Then, the ECU 40 computes a target phase based on the computed engine rotational speed NE and engine load. For example, when the internal combustion engine is operated under a normal operational range (medium load and medium NE), the target phase is computed such that a valve overlap, in which the intake valve and the exhaust valve are both opened, is increased in order to facilitate the improvement of fuel efficiency of the internal combustion engine and the reduction of the emission. In contrast, when the internal combustion engine is operated under a stand-by operation (low load and low NE), the target phase is computed to reduce the valve overlap such that combustion of the internal combustion engine is stabilized. Furthermore, the ECU 40 (controlling means) executes the feed-back control such that the difference between the actual phase and the target phase becomes zero.

The ECU 40 adjusts the duty of the control electric current applied to the electromagnetic solenoid 37 based on the target phase, and thereby adjusting the relative rotational phase of the VVT 20. As a result, the relative rotational phase of the camshaft 14 relative to the crankshaft 10 is adjusted. As a result, opening and closing timing of the exhaust valve or the intake valve of the internal combustion engine is adjusted, and thereby the valve overlap is adjusted. In the present embodiment, the VVT 20 is provided to the camshaft 14 that actuates the intake valve, and is not provided to the other camshaft that actuates the exhaust valve. However, the present embodiment is applicable to the VVT 20 that is provided to at least one of the camshafts of the intake and exhaust valves.

Figure 2:
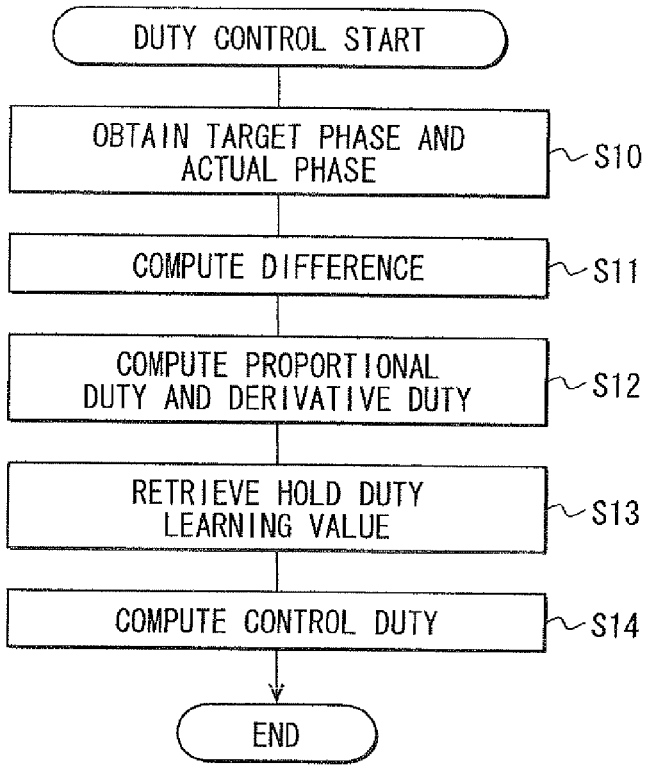
FIG. 2 is a flow chart illustrating a procedure for computing a control Duty value in a duty control of a control electric current according to the first embodiment.

FIG. 2 is a flow chart illustrating a procedure for computing a control Duty used in the control of control Duty or duty of the control electric current applied by the microcomputer 41 of the ECU 40 to the electromagnetic solenoid 37. The above process is repeatedly executed at predetermined intervals.

Firstly, at step S10 (corresponding to target phase computing means) in FIG. 2, the actual phase of the VVT 20, which is computed based on the detection values from the crank angle sensor 42 and the cam angle sensor 44, is obtained. Also, the target phase, which is computed based on the engine rotational speed NE and the engine load as above, is obtained. Then, control proceeds to step S11, where the difference between the target phase and the actual phase, which are obtained at step S10, is computed.

Control proceeds to step S12, where a proportional Duty and a derivative Duty used in the feed-back control are computed based on the difference computed at step S10. Specifically, the proportional Duty (feed-back correction value) is computed in proportion to the difference, and the derivative Duty (feed-back correction value) is computed in proportion to the rate of change of the difference.

In the present embodiment, a hold Duty indicates the value of the control Duty for a state, where an operational speed of the VVT 20 is zero, or in other words, where the actual phase of the VVT 20 is held substantially at a constant value. The hold Duty value is sequentially learned (stored and updated) in a routine process other than that in FIG. 2. Then, the learning value of the hold Duty is retrieved at step S13 in FIG. 2.

In the next step S14 (feed-back controlling means), the control Duty of the electric current applied to the electromagnetic solenoid 37 is computed based on the proportional Duty, the derivative Duty, and the learning value of the hold Duty obtained at steps S12, S13. Specifically, the value for the control Duty is obtained by adding the proportional Duty and the derivative Duty to the hold Duty learning value.

Figure 3:
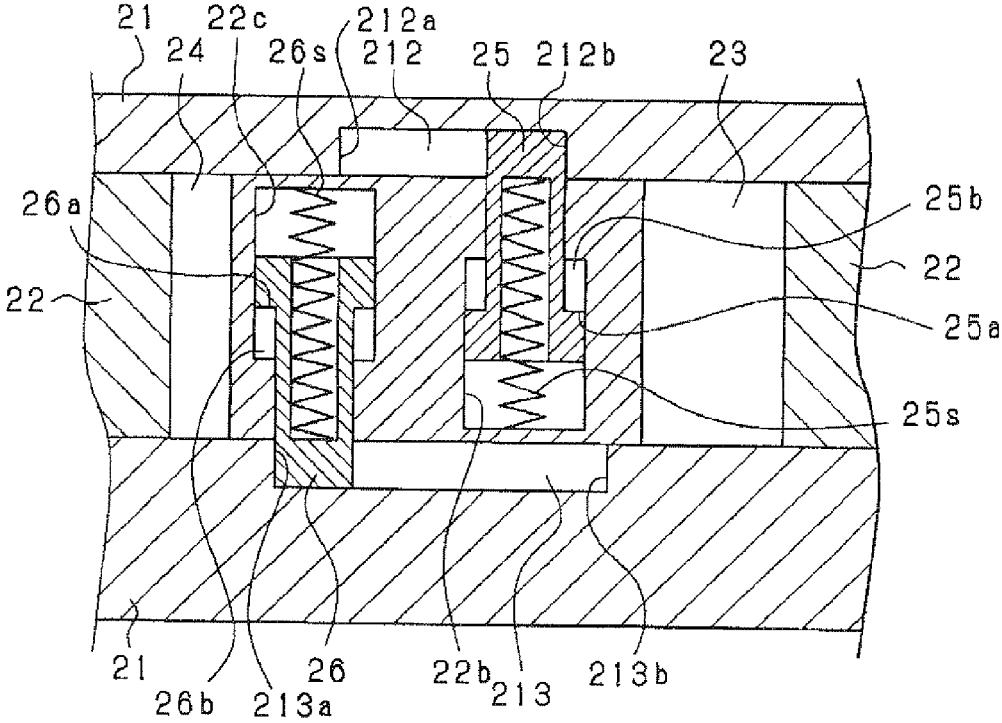
FIG. 3 is a cross-sectional view taken along lines III-III in FIG. 1.

FIG. 3 is a cross-sectional view of the VVT 20 taken along lines III-III in FIG. 1, and the lock mechanism of the VVT 20 will be described below with reference to FIGS. 1 and 3. The lock mechanism mainly includes an advance limitation pin 25, an advance limitation groove 212, a retard limitation pin 26, and a retard limitation groove 213.

The advance limitation pin 25 is reciprocably provided to a receiving hole 22*b* formed at the second rotor 22. FIG. 3 illustrates a state, in which the advance limitation pin 25 projects from the receiving hole 22*b*. The receiving hole 22*b* is provided with a spring 25*s* that applies a resilient force to the advance limitation pin 25 such that the spring 25*s* urges the advance limitation pin 25 toward a projection position in a projection direction. For example, the advance limitation pin 25 projects from the second rotor 22 when the limitation pin 25 is located at the projection position.

Also, the advance limitation pin 25 is provided with a pressure receiver 25*a*. When the pressure receiver 25*a* receives pressure of hydraulic oil that flows into a control chamber 25*b*, the advance limitation pin 25 is urged in a direction (retraction direction) opposite from the projection direction such that the advance limitation pin 25 is retracted to be received in the receiving hole 22*b* at a retraction position, at which the limitation pin 25 is retracted within the second rotor 22. Because it is designed that part of hydraulic oil discharged from the hydraulic pump 38 is supplied to the control chamber 25*b*, hydraulic oil pressure of the control chamber 25*b* has become sufficiently increased after a predetermined time period has elapsed since the hydraulic pump 38 starts operation upon the start of the engine. When hydraulic oil pressure in the control chamber 25*b* is increased to exceeds the resilient force of the spring 25*s*, the advance limitation pin 25 is displaced from the projection position to the retraction position such that the entirety of the advance limitation pin 25 is received by the receiving hole 22*b*. In contrast, when hydraulic oil pressure is reduced to below the resilient force of the spring 25*s* upon the stop of the engine, the resilient force of the spring 25*s* causes the advance limitation pin 25 to be displaced from the retraction position to the projection position.

It should be noted that the circulation (inflow and outflow) of hydraulic oil to the control chamber 25*b* is controlled by an OCV (not shown) other than the OCV 30. In other words, the circulation of hydraulic oil to the control chamber 25*b* is controlled independently of the control of circulation of hydraulic oil to the retard chambers 23 and the advance chambers 24. However, it should be noted that the OCV 30 in FIG. 1 may be alternatively replaced by a single OCV that is provided with an inflow port and a drain port to the control chamber 25*b*, and thereby the above alternative OCV may control the flow of hydraulic oil to the control chamber 25*b*, the retard chambers 23, and the advance chambers 24.

The advance limitation groove 212 is formed to first rotor 21, and receives therein an end of the advance limitation pin 25 that is located at the projection position. The advance limitation groove 212 has an arc shape such that the advance limitation pin 25 is displaceable within a predetermined angular range. Thus, when the advance limitation pin 25 is fitted into (or is engaged with) the advance limitation groove 212, a displacement range of the advance limitation pin 25, in which range the pin 25 is displaceable, is limited to a first limitation range W1 (see FIG. 4B). For example, the displacement range of the advance limitation pin 25 corresponds to a relative rotation range W0 (see FIG. 4B) of the second rotor 22 relative to the first rotor 21, to which the advance limitation pin 25 is provided.

The retard limitation pin 26 is reciprocably received within a receiving hole 22*c* that is formed to the second rotor 22. FIG. 3 shows a state, where the retard limitation pin 26 projects from the receiving hole 22*c*. The receiving hole 22*c* is provided with a spring 26*s* that applies resilient force to the retard limitation pin 26 in a projection direction such that the retard limitation pin 26 is displaced to a projection position, at which the limitation pin 26 projects from the receiving hole 22*c*. It should be noted that the retard limitation pin 26 projects in a direction opposite from a direction, in which the advance limitation pin 25 projects from the second rotor 22.

Also, the retard limitation pin 26 is provided with a pressure receiver 26*a*. When the pressure receiver 26*a* receives pressure of hydraulic oil that flows into a control chamber 26*b*, the retard limitation pin 26 is urged in a direction (retraction direction) opposite from the projection direction such that the retard limitation pin 26 is retracted to be received in the receiving hole 22*c* at a retraction position. It is designed that part of hydraulic oil discharged from the hydraulic pump 38 is supplied to the control chamber 26*b*. When hydraulic oil pressure in the control chamber 26*b* is increased to exceed the resilient force of the spring 26*s*, the retard limitation pin 26 is displaced from the projection position to the retraction position such that the entirety of the retard limitation pin 26 is received by the receiving hole 22*c*. In contrast, when hydraulic oil pressure is reduced to below the resilient force of the spring 26*s*, the resilient force of the spring 26*s* causes the retard limitation pin 26 to be displaced from the retraction position to the projection position.

It should be noted that the control chamber 26*b* of the retard limitation pin 26 is communicated with the control chamber 25*b* of the advance limitation pin 25. When hydraulic oil pressure is less than a predetermined value, the retard limitation pin 26 projects, and the advance limitation pin 25 projects. The above condition of the hydraulic oil pressure corresponds to a projection condition of the advance limitation pin 25 and a projection condition of the retard limitation pin 26. The projection condition of the advance limitation pin 25 coincides with the projection condition of the retard limitation pin 26, for example. Also, when hydraulic oil pressure is equal to or greater than a predetermined value, and an OCV operates to supply hydraulic oil to the control chambers 25*b*, 26*b*, the retard limitation pin 26 is retracted and the advance limitation pin 25 is retracted. The above condition of the hydraulic oil pressure and the OCV serves as a retraction condition of the advance limitation pin 25 and a retraction condition of the retard limitation pin 26. The retraction condition of the advance limitation pin 25 coincides with the retraction condition of the retard limitation pin 26, for example.

Figure 4A:
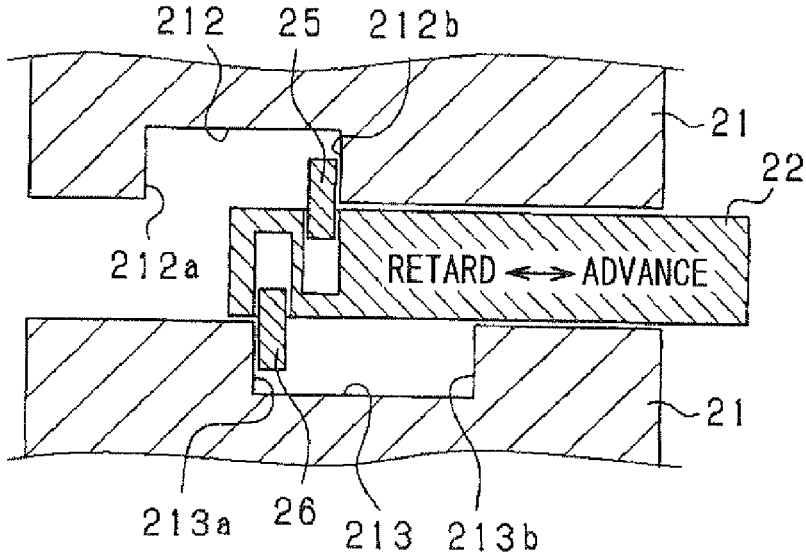
FIG. 4A is a schematic diagram illustrating a state, where lock pins are engaged with lock holes, according to the first embodiment.
Figure 4B:
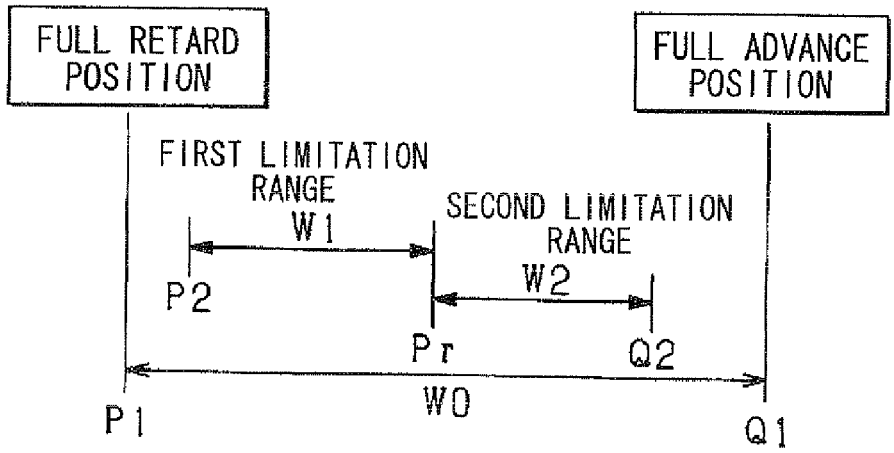
FIG. 4B is a diagram illustrating a relation between a first limitation range and a second limitation range according to the first embodiment.

The first rotor 21 has the retard limitation groove 213 located at a position opposed to the end of the limitation pin 26. When the retard limitation pin 26 is located at the projection position, the end part of the retard limitation pin 26 is engaged with the retard limitation groove 213. The retard limitation groove 213 has an arc shape such that the retard limitation pin 26 is displaceable in a predetermined angular range. As a result, when the retard limitation pin 26 is fitted into or engaged with the retard limitation groove 213, a displacement range of the retard limitation pin 26, in which range the retard limitation pin 26 is displaceable, is limited to a second limitation range W2 (see FIG. 4B). In other words, the relative rotation range of the second rotor 22, to which the retard limitation pin 26 is formed, relative to the first rotor 21 is limited to the second limitation range W2. It should be noted that the second limitation range W2 is different from the first limitation range W1 and includes the lock position Pr as shown in FIG. 4B.

The relative rotational phase indicates a certain position when the advance limitation pin 25 contacts an advance-end wall surface 212*b* or a wall surface located at an advance end of the advance limitation groove 212, and thereby the displacement of the advance limitation pin 25 in the advance direction is limited. The above certain position coincides with the position of the relative rotational phase when the retard limitation pin 26 contacts a retard-end wall surface 213*a* or a wall surface located at a retard end of the retard limitation groove 213, and thereby the displacement of the retard limitation pin 26 in the retard direction is limited. The above certain position of the relative rotational phase is a lock position Pr (see FIG. 4B). When the relative rotational phase is located at the lock position, the relative rotation between the rotors 21, 22 in the advance and also in the retard is limited, and thereby the relative rotational phase of the rotors 21, 22 is locked such that the relative rotational phase of the rotors 21, 22 is unchanged. In other words, as above, when the relative rotational phase is located at the lock position, the first rotor 21 and the second rotor 22 are locked such that the first rotor 21 is not rotatable relative to the second rotor 22.

It should be noted that in a case, where the retard limitation pin 26 is disengaged from the retard limitation groove 213, the displacement of the advance limitation pin 25 in the retard direction is limited when the advance limitation pin 25 contacts a retard-end wall surface 212*a* or a wall surface located on a retard end of the advance limitation groove 212. Similarly, in a case, where the advance limitation pin 25 is disengaged from the advance limitation groove 212, the displacement of the retard limitation pin 26 in the advance direction is limited when the retard limitation pin 26 contacts an advance-end wall surface 213*b* or a wall surface located on an advance end of the retard limitation groove 213.

When the engine is to be stopped, the target phase is set to the lock position such that the actual phase (actual position of the relative rotational phase) coincides with the lock position. The above control may be referred to as a lock control. As a result, because the relative rotational phase has been locked in the start of the engine in the next operation, it is possible to hold the relative rotational phase at the lock position without a large fluctuation of the relative rotational phase even in a period immediately after the start of the engine, in which period the oil pressure in the retard chambers 23 and the advance chambers 24 may not be sufficiently high. It should be noted that as shown in FIG. 4B, a lock position Pr of the present embodiment is set at the intermediate position in the relative rotation range W0, in which the relative rotational phase is changeable.

Next, technical feature of the advance limitation groove 212 and the retard limitation groove 213 will be described below.

When the above lock control is executed, both of the limitation pins 25, 26 are displaced to the advance-end wall surface 212*b* and the retard-end wall surface 213*a* (lock position), respectively. In practice, both of the limitation pins 25, 26 are displaced to the lock position while the limitation pins 25, 26 fluctuate in the advance direction and in the retard direction due to the variable torque (torque reversals) applied to the camshaft 14 from a valve spring. As a result, the advance limitation pin 25 may not be fitted into the lock hole 211 depending on the fluctuation disadvantageously in the conventional art.

In contrast, in the present embodiment, because there are provided the advance limitation groove 212 and the retard limitation groove 213, the relative rotation range is limited as above, and thereby it is possible to displace both of the limitation pins 25, 26 toward the lock position 212*b*, 213*a* while the range of the fluctuation is limited. As a result, it is possible to facilitate the fitting of the lock pin 25 into the lock hole 211, and thereby it is possible to effectively remove the above disadvantage of the conventional art.

The above advantage will be detailed with reference to FIGS. 4A to 4C. FIG. 4A is a schematic diagram illustrating a state, where the advance limitation pin 25 is fitted into the lock hole 211, and FIG. 48 is a diagram illustrating a relation between the relative rotation range W0, the first limitation range W1, and the second limitation range W2. As described above, the relative rotation range W0 corresponds to a range for a case, where both of the limitation pins 25, 26 are located at the respective retraction positions. The first limitation range W1 is defined by the advance limitation groove 212, and the second limitation range W2 is defined by the retard limitation groove 213.

Firstly, the operation for the case, where both of the limitation pins 25, 26 are located at the respective retraction positions or both of the limitation pins 25, 26 are received within the second rotor 22, will be described. For example, when both of the limitation pins 25, 26 are located at the retraction positions, the relative rotational phase is freely displaceable in a range (the relative rotation range W0) between the full retard position P1 and the full advance position Q1. Thus, it is possible to set the target phase at any position within the relative rotation range W0.

Next, the operation for the case, where the lock control of both of the limitation pins 25, 26 is executed.

For example, the advance limitation pin 25 is displaced in the advance direction from a position on a retard side of the retard-end wall surface 212*a* of the guide groove 212. Firstly, the advance limitation pin 25 is brought into the engagement with the advance limitation groove 212. At this time, although the advance limitation pin 25 may be urged in the retard direction by some force, the advance limitation pin 25 is prevented from being shifted in the retard direction further from the end of the limitation groove 212 because of the contact between the retard-end wall surface 212*a* of the advance limitation groove 212 and a side surface of the advance limitation pin 25. In other words, the phase of the VVT 20 (relative rotational phase) is prevented from being shifted in the retard direction further from a position P2 that corresponds to the retard-end wall surface 212*a* of the advance limitation groove 212 (see FIG. 4B).

Next, when the advance operation is further executed, the retard limitation pin 26 is brought into the engagement with the retard limitation groove 213. In the above case, although the retard limitation pin 26 may be urged in the retard direction by some force, the side surface of the retard limitation pin 26 contacts the retard-end wall surface 213*a* of the retard limitation groove 213 such that the displacement of the retard limitation pin 26 in the retard direction is effectively limited. In other words, the phase of the VVT 20 is prevented from being shifted in the retard direction further from the position (lock position Pr) that corresponds to the retard-end wall surface 213*a* of the retard limitation groove 213. Also, at the position, although the advance limitation pin 25 may be urged in the advance direction by some force, the side surface of the advance limitation pin 25 contacts the advance-end wall surface 212*b* of the advance limitation groove 212 such that the displacement of the advance limitation pin 25 in the advance direction is effectively limited. In other words, the phase of the VVT 20 is prevented from being shifted in the advance direction further from a position (lock position Pr) that corresponds to the advance-end wall surface 212*b* of the advance limitation groove 212.

Also, another case will be described. For example, when the retard operation is executed in a state, where the advance limitation pin 25 is located at a position on an advance side of the advance-end wall surface 212*b* of the advance limitation groove 212, the retard limitation pin 26 is brought into the engagement with the retard limitation groove 213. In this case, although the retard limitation pin 26 may be urged in the advance direction by some force, the retard limitation pin 26 is prevented from being displaced in the advance direction further from the end of the retard limitation groove 213 because of the contact between the advance-end wall surface 213*b* of the retard limitation groove 213 and the side surface of the retard limitation pin 26. In other words, the phase of the VVT 20 (relative rotational phase) is prevented from being shifted in the advance direction further from the position Q2 that corresponds to the advance-end wall surface 213*b* of the retard limitation groove 213 (see FIG. 4B).

When the retard operation is further executed, the advance limitation pin 25 is brought into the engagement with the advance limitation groove 212. In the above case, the advance limitation pin 25 may be urged in the advance direction by some force, the side surface of the advance limitation pin 25 contacts the advance-end wall surface 212*b* of the advance limitation groove 212 such that the advance limitation pin 25 is effectively limited from being shifted in the advance direction further from the advance end of the advance limitation groove 212. In other words, the phase of the VVT 20 is prevented from being shifted in the advance direction further from the position (lock position Pr) that corresponds to the advance-end we surface 212*b* of the advance limitation groove 212. Also, in the above position, although the retard limitation pin 26 may be urged in the retard advance direction by some force, the side surface of the retard limitation pin 26 contacts the retard-end wall surface 213*a* of the retard limitation groove 213 such that the retard limitation pin 26 is effectively limited from being shifted in the retard direction further from the retard end of the retard limitation groove 213. In other words, the phase of the VVT 20 is prevented from being shifted in the retard direction further from the position (lock position Pr) that corresponds to the retard-end wall surface 213*a* of the retard limitation groove 213.

Next, a lock release control will be described. In the lock release control, both of the limitation pins 25, 26, which are engaged with the respective limitation grooves 212, 213 for the lock of the relative rotational phase as shown in FIG. 4A, are displaced to the respective retraction position for releasing the lock.

Figure 5:
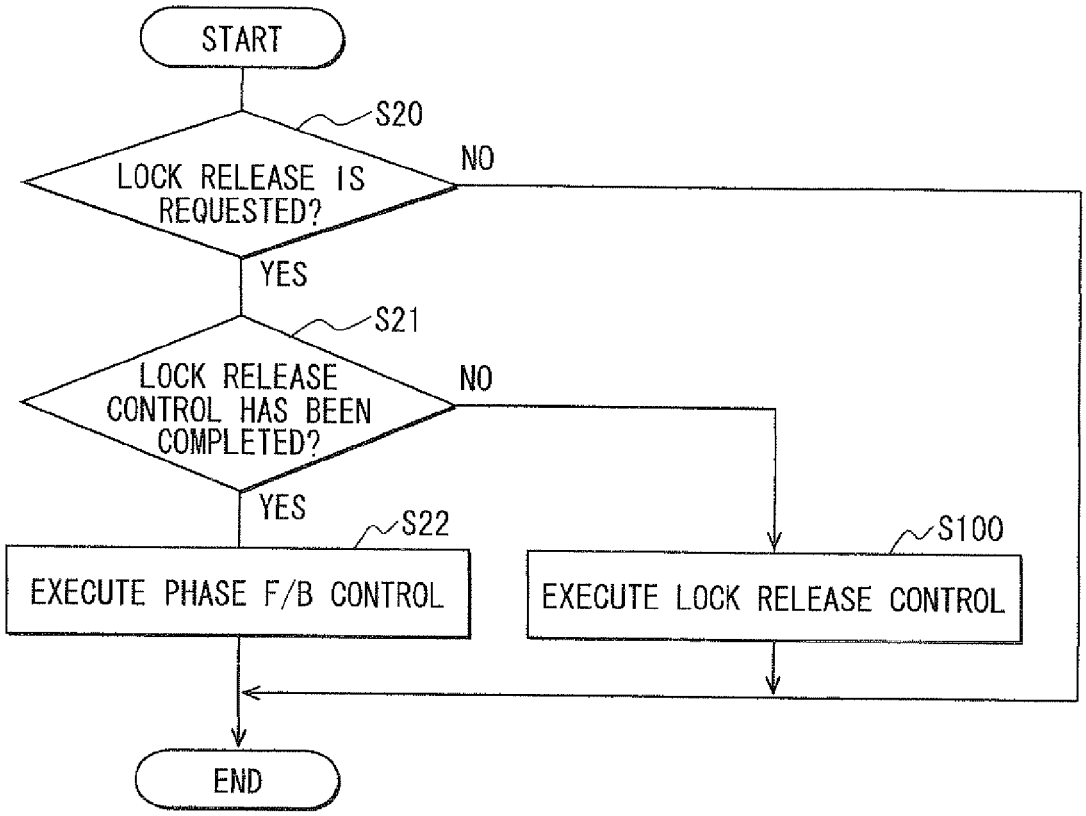
FIG. 5 is a flow chart illustrating a procedure for lock release control in the first embodiment.

FIG. 5 shows a flow chart of a main process that is executed by the microcomputer 41 at predetermined intervals. Firstly, it is determined at step S20 whether a lock release is requested. For example, when the limitation pin retraction condition is satisfied, it is determined that there is the lock release request. When it is determined that the lock release is requested, corresponding to YES at S20, and simultaneously when it is determined that the lock release control executed at step S100 has been completed, corresponding to YES at S21, control proceeds to step S22, where the VVT 20 is feed-back controlled in order to cause the phase to coincide with the target phase computed based on the engine operational state. Specifically, the OCV 30 is controlled based on the control Duty computed at step S14 in FIG. 2 in order to feed-back control the phase of the VVT 20.

Figure 6:
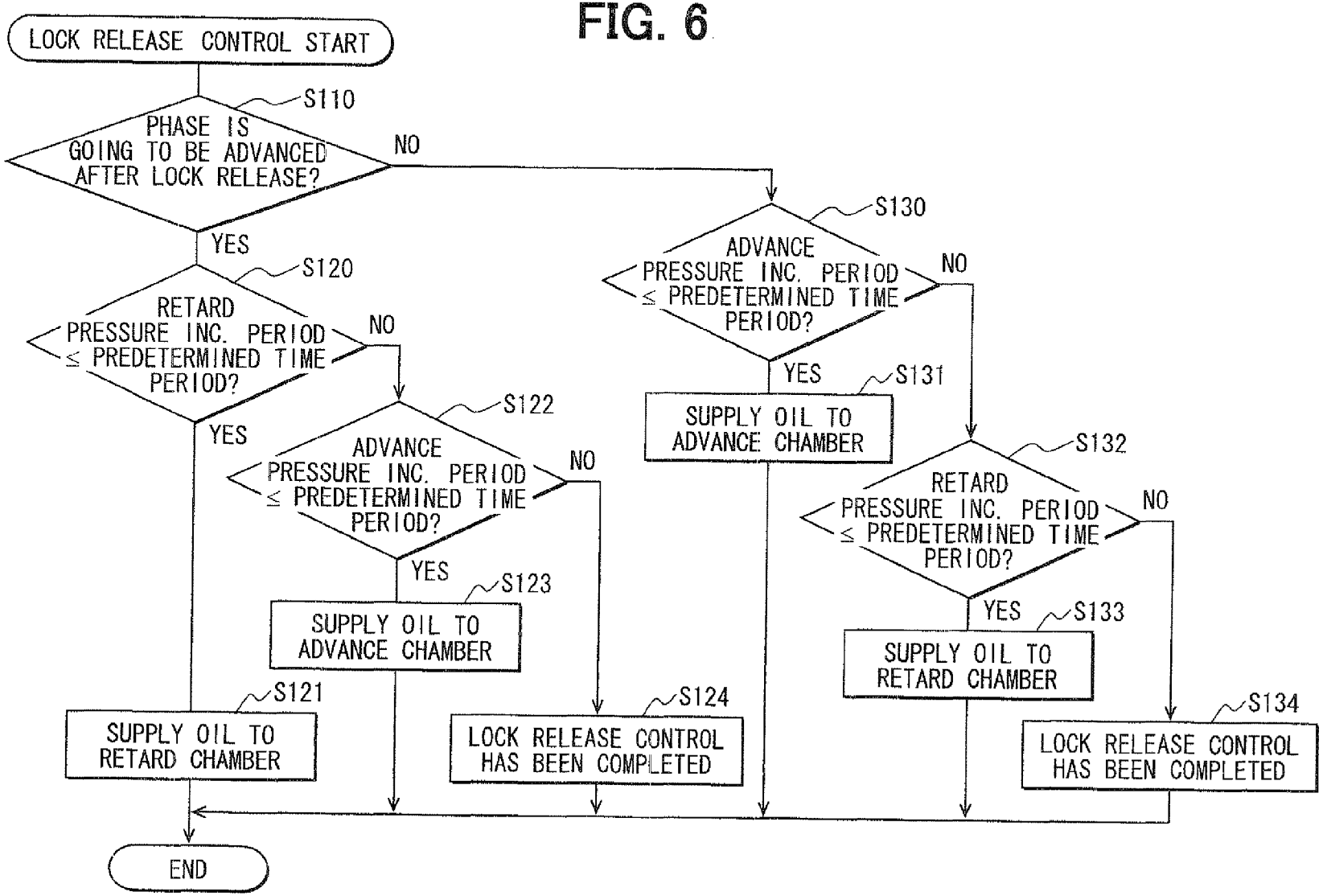
FIG. 6 is a flow chart illustrating a subroutine process of the process in FIG. 5.

In contrast, when it is determined that the lock release is requested, corresponding to YES at S20, and simultaneously when it is determined that the lock release control has not been completed, corresponding to NO at S21, control proceeds to step S100, where it is commanded that the lock release control shown in FIG. 6 is executed. FIG. 6 is a flow chart illustrating a procedure of the lock release control, and the lock release control is repeatedly executed by the microcomputer 41 at predetermined intervals.

In summary, in the process of FIG. 6, the OCV 30 is controlled such that hydraulic oil is alternately supplied to the retard chambers 23 and to the advance chambers 24. In other words, after hydraulic oil is supplied to only one of a retard chamber group (including the retard chambers 23) and an advance chamber group (including the advance chambers 24) for a predetermined time period, hydraulic oil is supplied to the other one of the retard chamber group and the advance chamber group for the predetermined time period.

The lock release control will be detailed below. Firstly, at step S110, it is determined whether the advance control, in which the relative rotational phase is shifted in the advance direction, is going to be executed in the feed-back control after the lock release. Specifically, it is determined whether the target phase obtained at step S10 in FIG. 2 is located on the retard side of the lock position or on the advance side of the lock position. When it is determined that the advance control is going to be executed after the lock release, corresponding to YES at S110, control proceeds to steps S120 to S124 (lock release controlling means), where the lock release control is executed. Specifically, in the lock release control, hydraulic oil is supplied to the retard chambers 23 for a predetermined time period, and then hydraulic oil is supplied to the advance chambers 24 for the predetermined time period.

For example, in the present specification, a retard chamber pressure increasing period indicates a time period, during which hydraulic oil is supplied to the retard chambers 23 in order to increase oil pressure in the retard chambers 23. For example, the retard chamber pressure increasing period indicates an elapsed time since the start of the supply of hydraulic oil to the retard chambers 23 in the lock release control. When it is determined that the retard chamber pressure increasing period is equal to or less than the predetermined time period, corresponding to YES at S120, the OCV 30 is open-loop controlled such that hydraulic oil is supplied to the retard chambers 23. The control Duty in the above open-loop control may be a value that maximizes a supply flow amount by causing the spool 35 to be placed at the rightmost position in FIG. 1. When it is determined that the retard chamber pressure increasing period reaches the predetermined time period, corresponding to NO at S120, hydraulic oil supply to the retard chambers 23 is ended, and control proceeds to step S122.

Furthermore, in the present specification, an advance chamber pressure increasing period is defined as a time period, during which hydraulic oil is supplied to the advance chambers 24 in order to increase oil pressure in the advance chambers 24. For example, the advance chamber pressure increasing period indicates an elapsed time since the start of supply of hydraulic oil to the advance chambers 24 in the lock release control. When it is determined that the advance chamber pressure increasing period is equal to or less than the predetermined time period, corresponding to YES at S122, the OCV 30 is open-loop controlled such that hydraulic oil is supplied to the advance chambers 24. In the above operation, the control Duty may be alternatively the control Duty computed at step S14 in FIG. 2. Note that the control Duty may be alternatively a value that maximizes the supply flow amount by causing the spoof 35 to be placed at a leftmost position in FIG. 1. Alternatively, the control Duty may be a value that reduces the supply flow amount to an amount that is smaller than the flow amount that has been supplied to the retard chambers 23. When it is determined that the advance chamber pressure increasing period reaches the predetermined time period, corresponding to NO at S122, the hydraulic oil supply to the advance chambers 24 is ended, and control proceeds to step S124, where a flag indicative of lock release control completion is turned on.

In contrast, when it is determined at step S110 that the advance control is not going to be executed after the lock release, corresponding to NO at S110, it is assumed that the retard control for retarding the phase in the retard direction is going to be executed after the lock release. Then, control proceeds to steps S130 to S134 (lock release controlling means), where the lock release control is executed. In the lock release control, firstly, hydraulic oil is supplied to the advance chambers 24 for the predetermined time period, and then hydraulic oil is supplied to the retard chambers 23 for the predetermined time period.

More specifically, when it is determined that the advance chamber pressure increasing period is equal to or less than the predetermined time period, corresponding to YES at S130, the OCV 30 is open-loop controlled such that hydraulic oil is supplied to the advance chambers 24. In the above control, the control Duty may be a value that maximizes the supply flow amount by causing the spool 35 to be placed at the leftmost position in FIG. 1. When it is determined that the advance chamber pressure increasing period reaches the predetermined time period, corresponding to NO at S130, the hydraulic oil supply to the advance chambers 24 is ended, and control proceeds to step S132.

When it is determined that the retard chamber pressure increasing period is equal to or less than the predetermined time period, corresponding to YES at S132, the OCV 30 is open-loop controlled such that hydraulic oil is supplied to the retard chambers 23. The control Duty of the above operation may be a control Duty computed at step S14 in FIG. 2. Alternatively, the control Duty may be a value that maximizes the supply flow amount by causing the spool 35 to be placed at the rightmost position in FIG. 1. Also, the control Duty may be a value that reduces the supply flow amount to an amount smaller than the supply flow amount that has been supplied to the advance chambers 24. When it is determined that the retard chamber pressure increasing period reaches the predetermined time period, corresponding to NO at S132, hydraulic oil supply to the retard chambers 23 is ended, and control proceeds to step S134, where the flag indicative of the lock release control completion is turned on.

Next, the operation of the limitation pins 25, 26 caused by the execution of the lock release control will be described. It should be noted that the description below uses an example, in which the hydraulic oil supply to the retard chambers 23 is executed in advance of the supply of hydraulic oil to the advance chambers 24.

Firstly, while hydraulic oil is supplied to the retard chambers 23, the side surface of the advance limitation pin 25 is not pressed against the advance-end wall surface 212*b* of the advance limitation groove 212. More specifically, because the side surface of the retard limitation pin 26 is pressed against the retard-end wall surface 213*a*, the clearance defined between the side surface of the retard limitation pin 26 and the retard-end wall surface 213*a* is removed. As a result, another clearance is formed between the side surface of the advance limitation pin 25 and the advance-end wall surface 212*b* by an amount equivalent to the removed clearance. Thus, in the period, during which hydraulic oil is supplied to the retard chambers 23, friction between the advance limitation pin 25 and the advance-end wall surface 212*b* is not generated. Accordingly, when the advance limitation pin 25 is to be displaced to the retraction position due to the hydraulic oil pressure in the control chamber 25*b*, the advance limitation pin 25 is smoothly displaceable without the friction that may otherwise deteriorate the displacement of the advance limitation pin 25. As a result, the advance limitation pin 25 is capable of quickly getting out of the advance limitation groove 212.

When the hydraulic oil supply to the retard chambers 23 is ended, and thereby hydraulic oil is supplied to the advance chambers 24 subsequently, it is assumed that the advance limitation pin 25 has been disengaged from the advance limitation groove 212. Thus, when hydraulic oil is supplied to the advance chambers 24 by the lock release control, the actual phase is successfully shifted from the lock position in the advance direction. As a result, the side surface of the retard limitation pin 26 is not pressed against the retard-end wall surface 213*a* of the retard limitation groove 213. Thus, in a period, during which hydraulic oil is supplied to the advance chambers 24, friction is not formed between the retard limitation pin 26 and the retard-end wall surface 213*a*. Accordingly, when the retard limitation pin 26 is displaced to the retraction position due to the hydraulic oil pressure in the control chamber 26*b*, the retard limitation pin 26 is smoothly displaceable without the friction that may otherwise deteriorate the displacement of the retard limitation pin 26. As a result, the retard limitation pin 26 is capable of quickly getting out of the retard limitation groove 213.

In the present embodiment, the lock mechanism includes the retard limitation pin 26, the advance limitation pin 25, the retard limitation groove 213, and the advance limitation groove 212. When the displacement of the retard limitation pin 26 in the retard direction is limited and simultaneously when the displacement of the advance limitation pin 25 in the advance direction is limited, the first rotor 12 and the second rotor 22 are locked (see FIG. 4A). Thus, the retard-side surface of the retard limitation pin 26 located at the corresponding lock position is opposed to the wall surface of the retard limitation groove 213, and the advance-side surface of the retard limitation pin 26 has an open space on the advance side thereof. Also, the advance-side surface of the advance limitation pin 25 located at the corresponding lock position is opposed to the wall surface of the advance limitation groove 212, and the retard-side surface of the advance limitation pin 25 has an open space on the retard side thereof.

As above, in the present embodiment, when the lock by the lock mechanism is released, the lock release control is executed, in which hydraulic oil is alternately supplied to the retard chambers 23 and to the advance chambers 24. Thereby, it is possible to quickly displace the limitation pins 25, 26 out of the limitation grooves 212, 213. As a result, it is possible to quickly execute the lock release, and thereby it is possible to effectively reduce the time required for causing the actual phase to coincide with the target phase after the start of the engine.

Furthermore, in the present embodiment, when the advance control is going to be executed in the feed-back control after the lock release, hydraulic oil supply to the retard chambers 23 is executed in advance of the hydraulic oil supply to the advance chambers 24 during the execution of the lock release control. In other words, in the lock release control, hydraulic oil is supplied firstly to the retard chambers 23, and then supplied to the advance chambers 24. Thus, it is possible to shift the actual phase to a position located on the advance side of the lock position before the execution of the advance control in the feed-back control. As a result, it is possible to quickly rotate the rotors to cause the phase to coincide with the target phase in the execution of the feed-back control after the lock release completion.

Similarly, when the retard control is going to be executed in the feed-back control after the lock release, hydraulic oil supply to the advance chambers 24 is executed in advance of hydraulic oil supply to the retard chambers 23 in the lock release control. Thus, before the execution of the retard control in the feed-back control it is possible to displace the actual phase to a position located on a retard side of the lock position. Thus, it is possible to quickly rotate the rotors to cause the phase to coincide with the target phase in the execution of the feed-back control after the lock release has been completed.

Also, in the lock release control, hydraulic oil is supplied firstly to one of the retard chamber group and the advance chamber group, and then hydraulic oil is supplied to the other one of the retard and advance chamber groups. The above alternate supply of hydraulic oil is executed based on the control Duty used in the feed-back control after the lock release. As a result, it is possible to quickly shift the relative rotational phase to the target phase in the feed-back control after the lock release has been completed.

As above, in the present embodiment, the order of increasing oil pressure in the chambers in the lock release control is determined based on whether the target phase is located on the retard side or on the advance of the lock position. In other words, one of the retard chamber group and the advance chamber group is determined (or selected) based on whether the target phase is located on a retard side or on an advance side of the lock position. Then, the oil pressure in the one of the retard chamber group and the advance chamber group is increased before the oil pressure in the other one of the retard chamber group and the advance chamber group is increased. As a result, it is possible to quickly shift the relative rotational phase of the first rotor 21 relative to the second rotor 22 toward the target phase after the lock release control has been completed.

Also, when hydraulic oil is supplied firstly to the one of the chamber groups, the OCV 30 is open-loop controlled by the control Duty that causes the maximum supply amount for supplying hydraulic oil. As a result, it is possible to reduce the time period for supplying hydraulic oil to the one of the chamber groups. Accordingly, it is possible to reduce the execution period for the lock release control, and thereby it is possible to reduce the time period required for causing the actual phase to coincide with the target phase after the engine start.

As above, when the first supply of hydraulic oil is executed to the retard chambers 23 or to the advance chambers 24, the OCV 30 is open-loop controlled. However, when the second supply of hydraulic oil is executed to the other chambers 23 or 24 in the alternate oil supply operation, the OCV 30 may be feed-back controlled based on the control Duty computed at step S14 in FIG. 2.

Second Embodiment

In the present embodiment, when it is detected that the lock has been released during the lock release control before the completion of the lock release control, the lock release control is forcibly ended at the time of the detection. It should be noted that the VVT 20 of the present embodiment has a hardware configuration similar to the hardware configuration of the first embodiment. Also, in the present embodiment, the processes similar to the processes in FIGS. 2 and 6 of the first embodiment are executed, and the process of FIG. 7 replaces the process of FIG. 5.

Figure 7:
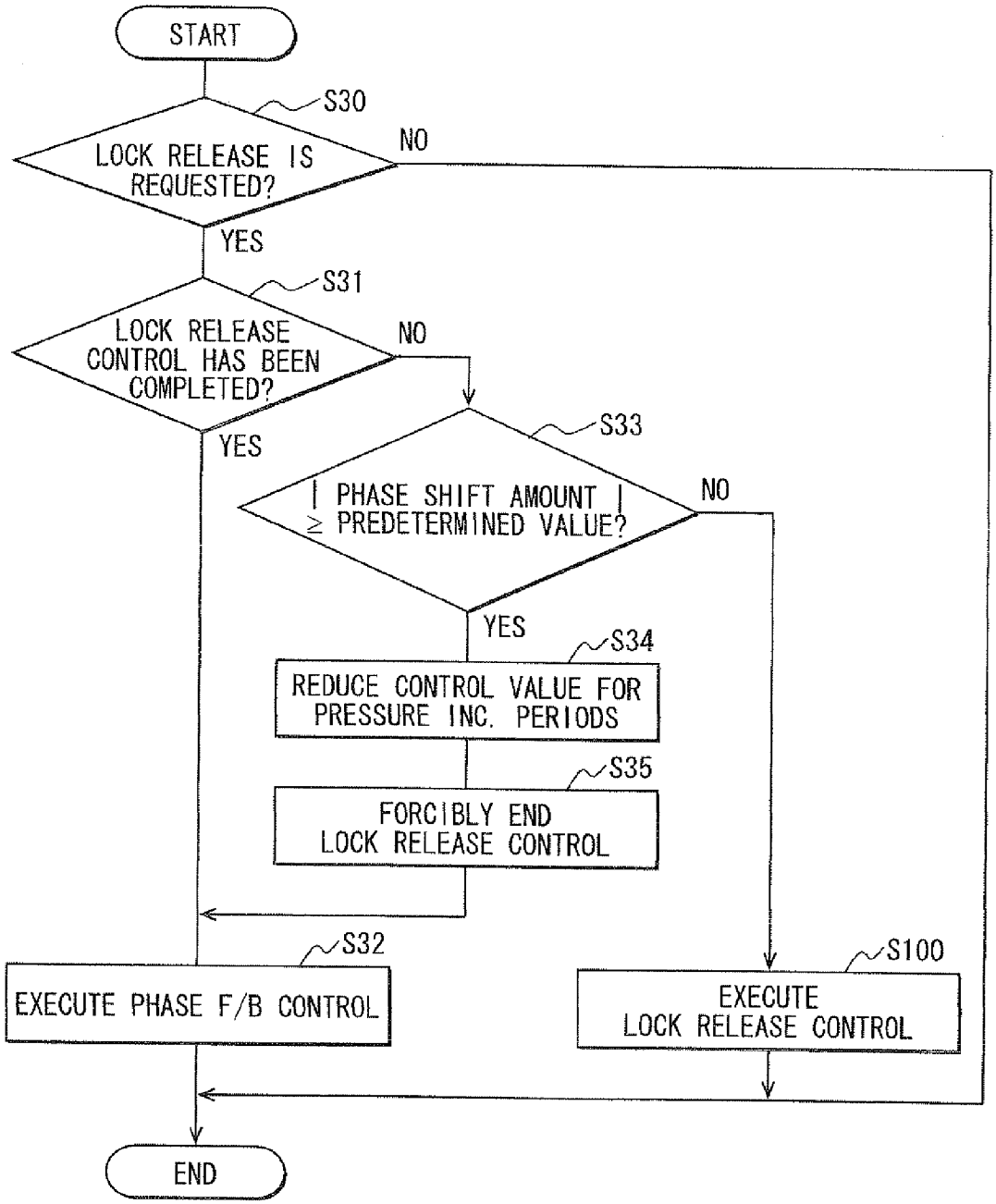
FIG. 7 is a flow chart illustrating a procedure for lock release control in the second embodiment of the present invention.

Firstly, it is determined at step S30 in FIG. 7 whether the lock release is requested. For example, when the limitation pin retraction condition is satisfied, it is determined that there is the lock release request. When it is determined that there is the lock release request, corresponding to YES at S30, and simultaneously when it is determined that the lock release control of step S100 has been completed, corresponding to YES at S31, control proceeds to step S32, where the VVT 20 is feed-back controlled such that the phase coincides with the target phase computed based on the engine operational state. Specifically, by controlling the OCV 30 based on the control Duty computed at step S14 in FIG. 2, the phase of the VVT 20 is feed-back controlled.

In contrast, when it is determined that the lock release is requested, corresponding to YES at S30, but simultaneously when it is determined that the lock release control has not been completed, corresponding to NO at S31, control proceeds to step S33, where a displacement amount (phase shift amount) of the actual phase generated during the execution of the lock release control is computed. Then, it is determined whether an absolute value of the computed phase shift amount is equal to or greater than a predetermined value. The predetermined value may be computed by summing (a) a clearance between the retard limitation pin 26 located at the lock position and the retard-end wall surface 213*a* and (b) a clearance between the advance limitation pin 25 located at the lock position and the advance-end wall surface 212*b*. Alternatively, the predetermined value may be a value that is substantially greater than a value made by adding a computation error of the phase to the above summed clearances.

When it is determined that the absolute value of the phase shift amount is equal to or greater than the predetermined value, corresponding to YES at S33, it is estimated that the lock has been released even before the lock release control has been completed, and thereby control proceeds to step S34. In contrast, when it is determined that the absolute value of the phase shift amount is less than the predetermined value, corresponding to NO at S33, control proceeds to step S100, where it is commanded to execute the lock release control shown in FIG. 6.

When the lock of the phase or the lock of the rotors 21, 22 is successfully released before the lock release control has been completed, it is assumed that the retard chamber pressure increasing period and the advance chamber pressure increasing period have sufficient length for enabling the lock release. In other words, it is assumed that a control value for the retard chamber pressure increasing period and a control value for the advance chamber pressure increasing period are set excessively long.

In the present embodiment, the control values for the retard chamber pressure increasing period and the advance chamber pressure increasing period are changeable and stored for update. For example, the above control values correspond to the predetermined time period used in the determination of steps S120, S122, S130, and S132 in FIG. 6. When the determination at step S33 corresponds to YES, control proceeds to step S34 (time period setting means), where the control value of the retard chamber pressure increasing period and the control value of the advance chamber pressure increasing period are shortened or reduced. Then, control proceeds to step S35, where the lock release control is forcibly ended, and the feed-back control is executed at step S32. In other words, for example, even when the determination at step S120 or step S122 in FIG. 6 would otherwise correspond to YES, the execution of the process in steps S121, 123 is forcibly stopped.

As above, according to the present embodiment, when the relative rotational phase is shifted by an amount equal to or greater than a predetermined amount during the execution of the lock release control, corresponding to YES at S33, the lock release control is forcibly ended, and then the VVT 20 is feed-back controlled for causing the relative rotational phase to coincide with the target phase computed based on the engine operational state. Thus, it is possible to prevent the execution of the lock release control for a period longer than needed, and thereby it is possible to quickly shift the relative rotational phase to the desired phase after the engine start.

Furthermore, according to the present embodiment, when the lock release control is forcibly ended as above (or in other words, when the lock has been successfully released before the lock release control has been completed), the control values for the retard and advance chamber pressure increasing periods are reduced and stored for the next operation. In other words, when the lock release control is forcibly ended, each of the retard chamber pressure increasing period and the advance chamber pressure increasing period is updated from (a) a corresponding first control value used in a current operation of the lock release control to (b) a corresponding second control value used in a next operation of the lock release control, and the corresponding second control value is smaller than the corresponding first control value. As a result, it is possible to prevent the retard and advance chamber pressure increasing periods from becoming longer than necessary in the next execution of the lock release control. As a result, it is possible to reduce the time before the lock is released after the engine start.

Third Embodiment

In the present embodiment, when the relative rotational phase has not been shifted from the lock position as required even after the execution of the lock release control, the lock release control is re-executed. It should be noted that hardware configuration of the VVT 20 of the present embodiment is similar to the hardware configuration in the first embodiment. Also, in the present embodiment, the processes similar to those in FIG. 2 and FIG. 6 of the first embodiment are executed, and process in FIG. 8 replaces the process in FIG. 5.

Figure 8:
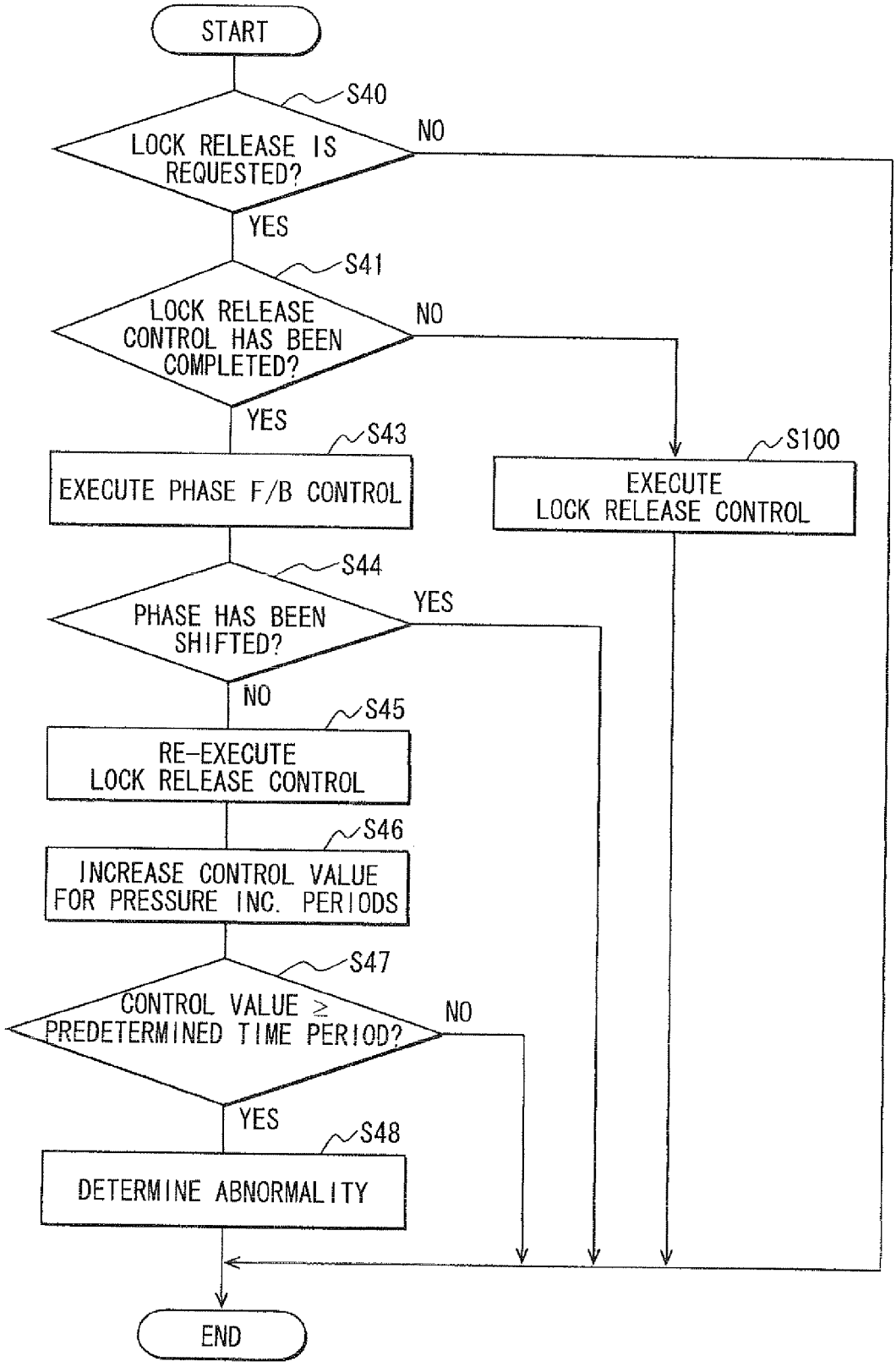
FIG. 8 is a flow chart illustrating a procedure for lock release control in the third embodiment of the present invention.
Figure 9A:
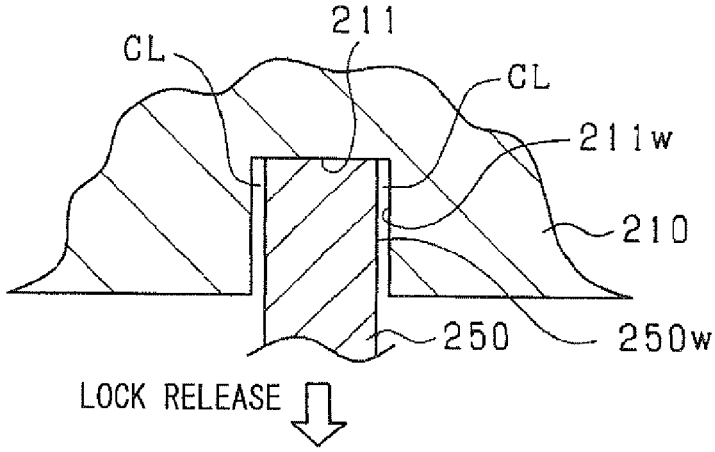
FIG. 9A PRIOR ART
FIG. 9A is a cross-sectional view schematically illustrate a structure of a conventional lock mechanism.
Figure 9B:
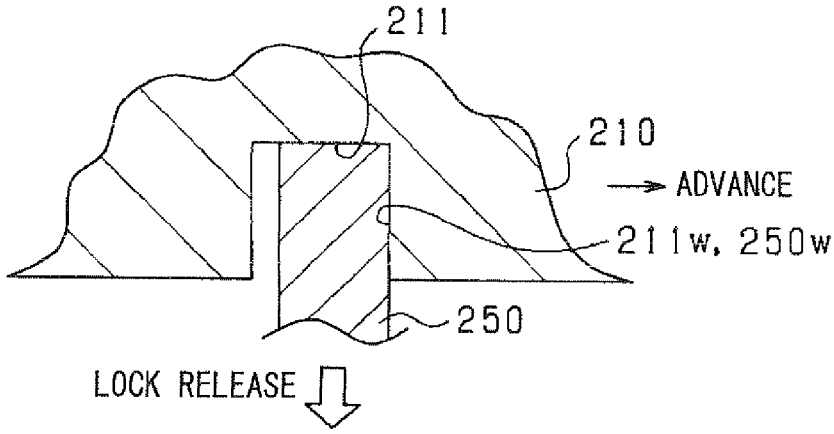
FIG. 9B PRIOR ART
FIG. 9B is another cross-sectional view schematically illustrate the structure of the conventional lock mechanism.
Figure 9C:
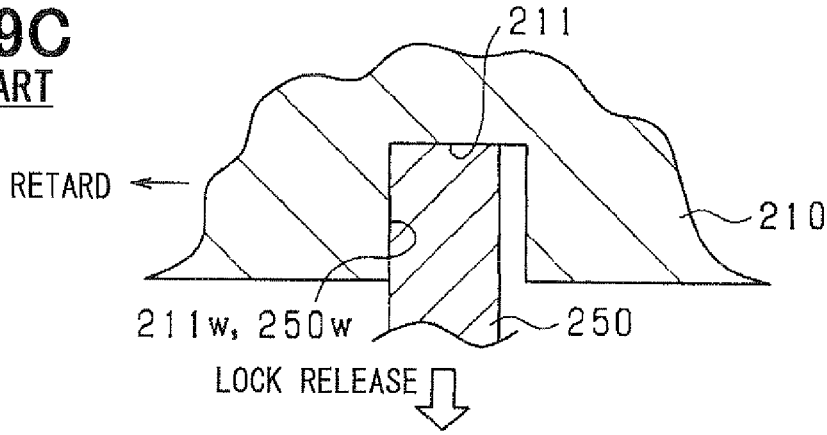
FIG. 9C PRIOR ART
FIG. 9C is another cross-sectional view schematically illustrate the structure of the conventional lock mechanism.

Firstly, it is determined at step S40 in FIG. 8 whether the lock release is requested. For example, when the limitation pin retraction condition is satisfied, it is determined that there is the lock release request. When it is determined that the lock release is requested, corresponding to YES at S40, and simultaneously when it is determined that the lock release control of step S100 has been completed, corresponding to YES at S41, control proceeds to step S43, where the VVT 20 is feed-back controlled such that the phase coincides with the target phase computed based on the engine operational state. Specifically, by controlling the OCV 30 based on the control Duty computed at step S14 in FIG. 2, the phase of the VVT 20 is feed-back controlled.

In contrast, when it is determined that the lock release is requested, corresponding to YES at S40, but simultaneously when it is determined that the lock release control has not been completed, corresponding to NO at S41, control proceeds to step S100, where it is commanded to execute the lock release control shown in FIG. 6.

Next, when it is determined that the actual phase has not been shifted from the lock position even after the feed-back control at step S43 is executed, corresponding to NO at S44, control proceeds to step S45, where the lock release control shown in FIG. 6 is executed again.

When the lock release has failed as above, corresponding to NO as S44, it is assumed that the control value for the retard chamber pressure increasing period and the control value for the advance chamber pressure increasing period are set excessively short.

In the present embodiment, the control value for the retard chamber pressure increasing period and the control value for the advance chamber pressure increasing period are changeable and stored for update. More specifically, the control values correspond to the predetermined time period used in the determination at steps S120, S122, S130, S132 in FIG. 6. Then, control proceeds from step S45 to step S46 (time period setting means), where the control value of the retard chamber pressure increasing period and the control value of the advance chamber pressure increasing period are elongated or increased.

Then, control proceeds to step S47, where it is determined whether the control value for the advance and retard chamber pressure increasing periods changed at step S46 is longer (greater) than the predetermined time period. When it is determined that the control value, which defines the time for supplying hydraulic oil in the lock release control, is longer than the predetermined time period, corresponding to YES at S47, it is determined that the lock mechanism is under the abnormal condition.

For example, the limitation pin may become abnormally immovable at the projection position and thereby becoming incapable of being displaced to the retraction position. When the lock mechanism is operated under the abnormal condition as above, the lock release may not be successfully executed even when the retard chamber pressure increasing period and the advance chamber pressure increasing period are substantially elongated. In view of the above, in the present embodiment, when at least one of the control value for the retard chamber pressure increasing period and the control value for the advance chamber pressure increasing period becomes equal to or greater than a predetermined time period, it is determined the lock mechanism is operated under the abnormal condition.

According to the present embodiment, when it is not possible to shift the relative rotational phase from the lock position (or in other words, when the lock has not been successfully released as required) even after the lock release control is executed once, the lock release control is executed again. As a result, the lock release is reliably completed effectively.

Furthermore, according to the present embodiment, when the lock release control is re-executed (or in other words, when the lock release has failed), the control value for the advance and retard chamber pressure increasing periods are increased and stored for update. In other words, when the lock release control is re-executed, each of the retard chamber pressure increasing period and the advance chamber pressure increasing period is updated from (a) a corresponding first control value used in a current operation of the lock release control to (b) a corresponding second control value used in a next operation of the lock release control, and the corresponding second control value is greater than the corresponding first control value. Thus, it is possible to reduce the possibility of failure in the lock release in the lock release control in the next operation.

Also, according to the present embodiment, it is determined that the lock mechanism is under the abnormal condition when the updated control value (the corresponding second control value) for the chamber pressure increasing periods becomes longer than the predetermined time period. Thus, it is possible to employ the changed control value (the second control value), which is made for the prevention of the lock release failure, as an effective method for determining the abnormal state of the lock mechanism.

Fourth Embodiment

In the second and third embodiments, the control value for the retard chamber pressure increasing period and the advance chamber pressure increasing period is changeable and the changed control value is stored and updated. The control value corresponds to the predetermined time period used in the determination at steps S120, S122, S130, and S132 in FIG. 5. In the present embodiment, the predetermined time period used in the determination at steps S120, S122, S130, and S132 is changed in accordance with a current temperature of hydraulic oil or a physical quantity correlated with the temperature. Specifically, when a detected coolant temperature, which is detected at a time of the lock release control, indicates lower, the predetermined time period is made longer. Also, when the detected coolant temperature indicates higher, the predetermined time period is made shorter. It should be noted that in the present embodiment, an engine coolant temperature detected by the coolant sensor 48 is employed as the physical quantity.

According to the present embodiment, when temperature of hydraulic oil is lower, the advance and retard chamber pressure increasing periods become larger. For example, in the execution of the lock release control, in which hydraulic oil is supplied to the retard chambers 23 after hydraulic oil is supplied to the advance chambers 24, it is, possible to improve the certainty of holding the retard limitation pin 26 away from the retard-end wall surface 213*a* (without pressed against the wall surface 213*a*) while hydraulic oil is supplied to the advance chambers 24. Also, according to the present embodiment, when the temperature of hydraulic oil is higher, the advance and retard chamber pressure increasing periods become smaller. As a result, it is possible to prevent the advance and retard chamber pressure increasing periods from becoming greater than necessary, and thereby it is possible to quickly shift the phase to the desired phase after the engine start.

Fifth Embodiment

In the second and third embodiments, the control value for the retard chamber pressure increasing period and the advance chamber pressure increasing period is changed and stored. For example, the control value corresponds to the predetermined time period used in the determination at steps S120, S122, S130, and S132 in FIG. 6. In the present embodiment, the predetermined time period used in the determination at steps S120, S122, S130, and S132 is changed in accordance with the engine rotation speed. Specifically, when the detected engine rotation speed is lower, the predetermined time period is made longer. When the engine rotation speed is higher, the predetermined time period is made shorter.

According to the present embodiment, when the engine rotation speed is lower, the advance and retard chamber pressure increasing periods are made longer (greater), as above. As a result, for example, in the execution of the lock release control, in which hydraulic oil is firstly supplied to the advance chambers 24 and then hydraulic oil is supplied to the retard chambers 23, it is possible to improve the certainty of holding the retard limitation pin 26 away from the retard-end wall surface 213*a* (without pressed against the wall surface 213*a*) while hydraulic oil is supplied to the advance chambers 24. Also, according to the present embodiment, when the engine rotation speed is higher, the advance and retard chamber pressure increasing periods are made shorter (smaller). As a result, it is possible to prevent the advance and retard chamber pressure increasing periods from becoming greater than necessary, and thereby it is possible to quickly shift the phase to the desired phase after the engine start.

Sixth Embodiment

The first rotor 21 or the second rotor 22, which rotate synchronously with the camshaft is subjected to the torque applied from the valve spring of the intake valve or the exhaust valve, and the torque periodically changes. In general, variable torque (torque reversals) that urges the relative rotational phase in the retard direction is greater than variable torque (torque reversals) that urges the phase in the advance direction. In other words, average variable torque (torque reversal) is applied in the retard direction. As a result, the phase change speed may vary depending on whether to apply a predetermined oil pressure to the advance chamber or to the retard chamber. Also, the above phenomena may be caused by the structure of the first rotor 21 and the second rotor 22.

In the second and third embodiments, the control value for the retard chamber pressure increasing period and the advance chamber pressure increasing period is changed and updated. Specifically, the control value corresponds to the predetermined time period used at steps S120, S122, S130, and S132 in FIG. 6. However, in the present embodiment, a predetermined time period used in the determination at each of steps S120, S122, S130, and S132 is independently and differently determined. According to the present embodiment, for example, in view of the average of the variable torque (torque reversals), which urges the phase in the retard direction, the control value for the retard chamber pressure increasing period is made slightly shorter than the control value for the advance chamber pressure increasing period. In the above case, the retard chamber pressure increasing period and the advance chamber pressure increasing period for successfully enabling the lock release are effectively set.

Additional advantages and modifications will readily occur to those skilled in the art. The invention in its broader terms is therefore not limited to the specific details, representative apparatus, and illustrative examples shown and described.

What is claimed is:

1. A valve timing adjuster for an engine having a camshaft and an output shaft, the camshaft opening and closing one of an intake valve and an exhaust valve of the engine, the valve timing adjuster comprising:

a first rotor that is rotatable synchronously with one of the camshaft and the output shaft;

a second rotor that is rotatable synchronously with the other one of the camshaft and the output shaft, the second rotor defining a retard chamber and an advance chamber between the first rotor and the second rotor;

a control valve configured to control supply of hydraulic oil to the retard chamber and the advance chamber;

controlling means for controlling the control valve to increase oil pressure of hydraulic oil in the retard chamber in order to shift a relative rotational phase between the first rotor and the second rotor in a retard direction, the controlling means controlling the control valve to increase oil pressure of hydraulic oil in the advance chamber in order to shift the relative rotational phase in an advance direction; and a lock mechanism configured to lock the first rotor and the second rotor at a lock position located between a full retard position and a full advance position such that the first rotor is limited from being rotated relative to the second rotor, wherein:

the lock mechanism includes a retard limitation pin and an advance limitation pin, each of which is provided to the second rotor;

each of the retard limitation pin and the advance limitation pin is displaced from a corresponding retraction position, at which each of the limitation pins is retracted within the second rotor, to a corresponding projection position, at which each of the limitation pins projects from the second rotor, when a projection condition is satisfied;

each of the limitation pins is displaced to the corresponding retraction position when a retraction condition is satisfied;

the lock mechanism includes a retard limitation groove and an advance limitation groove, each of which is formed to the first rotor;

the retard limitation groove limits the retard limitation pin, which is located at the corresponding projection position, from being displaced in the retard direction;

the advance limitation groove limits the advance limitation pin, which is located at the corresponding projection position, from being displaced in the advance direction;

the retard limitation groove and the advance limitation groove are designed to limit the displacement of the retard limitation pin in the retard direction and simultaneously limit the displacement of the advance limitation pin in the advance direction in order to lock the first rotor and the second rotor such that the first rotor is limited from being rotated relative to the second rotor;

the controlling means includes lock release controlling means for alternately increasing the oil pressure in the retard chamber and the oil pressure in the advance chamber when the lock of the first and second rotors is released by displacing each of the retard limitation pin and the advance limitation pin from the corresponding projection position to the corresponding retraction position.

2. The valve timing adjuster according to claim 1, further comprising target phase computing means for computing a target phase based on an operational state of the engine, wherein:

the lock release controlling means determines one of the retard chamber and the advance chamber based on whether the target phase is located on a retard side or on an advance side of the lock position; and the lock release controlling means increases the oil pressure in the one of the retard chamber and the advance chamber before increasing the oil pressure in the other one of the retard chamber and the advance chamber.

3. The valve timing adjuster according to claim 2, wherein the lock release controlling means increases the oil pressure in the advance chamber before the lock release controlling means increases the oil pressure in the retard chamber when the target phase is located on the retard side of the lock position.

4. The valve timing adjuster according to claim 2, wherein the lock release controlling means increases the oil pressure in the retard chamber before the lock release controlling means increases the oil pressure in the advance chamber when the target phase is located on the advance side of the lock position.

5. The valve timing adjuster according to claim 1, wherein the lock release controlling means forcibly end the lock release control when the relative rotational phase is shifted by an amount that is equal to or greater than a predetermined amount while the lock release control is executed.

6. The valve timing adjuster according to claim 5, further comprising:

time period setting means for setting a retard chamber pressure increasing period and an advance chamber pressure increasing period, the oil pressure in the retard chamber being increased for the retard chamber pressure increasing period while the lock release control is executed, the oil pressure in the advance chamber being increased for the advance chamber pressure increasing period while the lock release control is executed; and when the lock release controlling means forcibly end the lock release control, the time period setting means updates each of the retard chamber pressure increasing period and the advance chamber pressure increasing period from a corresponding first control value used in a current operation of the lock release control to a corresponding second control value used in a next operation of the lock release control, the corresponding second control value being smaller than the corresponding first control value.

7. The valve timing adjuster according to claim 1, wherein the lock release controlling means re-executes the lock release control when the controlling means is incapable of shifting the relative rotational phase from the lock position even after the lock release controlling means has completed the lock release control.

8. The valve timing adjuster according to claim 7, further comprising:

time period setting means for setting a retard chamber pressure increasing period and an advance chamber pressure increasing period, the oil pressure in the retard chamber being increased for the retard chamber pressure increasing period while the lock release control is executed, the oil pressure in the advance chamber being increased for the advance chamber pressure increasing period while the lock release control is executed; and when the lock release controlling means re-executes the lock release control, the time period setting means updates each of the retard chamber pressure increasing period and the advance chamber pressure increasing period from a corresponding first control value used in a current operation of the lock release control to a corresponding second control value used in a next operation of the lock release control, the corresponding second control value being greater than the corresponding first control value.

9. The valve timing adjuster according to claim 8, further comprising:

abnormality determination means for determining that the lock mechanism is operated under an abnormal condition when at least one of the corresponding second control value of the retard chamber pressure increasing period and the corresponding second control value of the advance chamber pressure increasing period becomes equal to or greater than a predetermined time period.

10. The valve timing adjuster according to claim 1, further comprising:

time period setting means for setting a retard chamber pressure increasing period and an advance chamber pressure increasing period, the oil pressure in the retard chamber being increased for the retard chamber pressure increasing period while the lock release control is executed, the oil pressure in the advance chamber being increased for the advance chamber pressure increasing period while the lock release control is executed; and the time period setting means changes the retard chamber pressure increasing period and the advance chamber pressure increasing period based on temperature of hydraulic oil or a physical quantity related to the temperature of hydraulic oil.

11. The valve timing adjuster according to claim 1, further comprising:

time period setting means for setting a retard chamber pressure increasing period and an advance chamber pressure increasing period, the oil pressure in the retard chamber being increased for the retard chamber pressure increasing period while the lock release control is executed, the oil pressure in the advance chamber being increased for the advance chamber pressure increasing period while the lock release control is executed; and hydraulic pump that is driven by the output shaft, the hydraulic pump supplying hydraulic oil to the retard chamber and the advance chamber, wherein:

the time period setting means changes the retard chamber pressure increasing period and the advance chamber pressure increasing period based on a rotational speed of the output shaft.

12. The valve timing adjuster according to claim 1, wherein:

a retard chamber pressure increasing period is a time period for increasing the oil pressure in the retard chamber while the lock release control is executed;

an advance chamber pressure increasing period is a time period for increasing the oil pressure in the advance chamber while the lock release control is executed; and the retard chamber pressure increasing period is set independently of the advance chamber pressure increasing period.

13. The valve timing adjuster according to claim 1, further comprising:

time period setting means for setting a retard chamber pressure increasing period and an advance chamber pressure increasing period, the oil pressure in the retard chamber being increased for the retard chamber pressure increasing period while the lock release control is executed, the oil pressure in the advance chamber being increased for the advance chamber pressure increasing period while the lock release control is executed, wherein:

the time period setting means sets the retard chamber pressure increasing period independently of the advance chamber pressure increasing period.

* * * * *